US012258827B2

(12) United States Patent
Cheng et al.

(10) Patent No.: US 12,258,827 B2
(45) Date of Patent: Mar. 25, 2025

(54) COMPLIANT COMPRESSION PLATE FOR A SLIP HANGER OR PACKOFF

(71) Applicant: Baker Hughes Oilfield Operations LLC, Houston, TX (US)

(72) Inventors: Samuel Cheng, Katy, TX (US); Paul Cody, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/122,539

(22) Filed: Mar. 16, 2023

(65) Prior Publication Data

US 2024/0309716 A1 Sep. 19, 2024

(51) Int. Cl.
*E21B 23/01* (2006.01)
*E21B 23/06* (2006.01)
*E21B 43/10* (2006.01)

(52) U.S. Cl.
CPC ..... *E21B 23/01* (2013.01); *E21B 23/06* (2013.01); *E21B 43/10* (2013.01)

(58) Field of Classification Search
CPC ..... E21B 23/01; E21B 23/06; E21B 43/10
See application file for complete search history.

(56) References Cited

U.S. PATENT DOCUMENTS 4,131,287 A * 12/1978 Gunderson ..... F16J 15/185 277/328
4,350,346 A * 9/1982 Fowler ..... F16J 15/20 277/627
4,390,063 A 6/1983 Wells, Jr.
4,678,209 A * 7/1987 Guice ..... E21B 33/0422 285/123.6
5,031,695 A * 7/1991 Cain ..... E21B 33/0422 166/208
6,375,414 B1 * 4/2002 Delaney ..... F16J 15/18 415/113
8,631,878 B2 * 1/2014 Duong ..... E21B 33/04 277/327
8,870,186 B2 * 10/2014 Hoang ..... E21B 33/04 277/327
9,308,566 B2 4/2016 Ring
9,341,039 B2 5/2016 Galle
10,184,311 B2 1/2019 Gadre
2011/0227296 A1 * 9/2011 Baca ..... F16J 15/062 277/626
2012/0248703 A1 10/2012 Kocurek
(Continued)

OTHER PUBLICATIONS

Patel et al., "Investigation of Elastomer Seal Energization: Implications for Conventional and Expandable Hanger Assembly," Feb. 25, 2019, Energies, 4 pages, abstract only.

(Continued)

*Primary Examiner* — Steven A Macdonald
(74) *Attorney, Agent, or Firm* — Hogan Lovells US LLP

(57) ABSTRACT

In at least one embodiment, a compression plate to be used with a slip hanger or a packoff in oilfield equipment is disclosed. The compression plate includes one or more grooves or slots extending circumferentially with respect to an axis of the slip hanger or the packoff. The compression plate is to be associated with an annulus seal gland of the slip hanger or the packoff and is to enable a gland volume of the annulus seal gland to change with temperature applied to the slip hanger or the packoff.

20 Claims, 8 Drawing Sheets

(56) References Cited

U.S. PATENT DOCUMENTS

| | | | | |
|---|---|---|---|---|
| 2012/0285676 | A1 | 11/2012 | Shaw | |
| 2013/0180705 | A1* | 7/2013 | Fuglestad | E21B 33/128 166/135 |
| 2014/0062025 | A1* | 3/2014 | Hoang | E21B 33/04 277/328 |
| 2014/0131954 | A1* | 5/2014 | Koleilat | F16J 15/068 277/336 |
| 2019/0264522 | A1* | 8/2019 | McGuire | E21B 33/03 |

OTHER PUBLICATIONS

International Search Report and Written Opinion mailed Jun. 26, 2024 in corresponding PCT Application No. PCT/US2024/019363.

* cited by examiner

COMPLIANT COMPRESSION PLATE FOR A SLIP HANGER OR PACKOFF

BACKGROUND

1. Technical Field

This disclosure relates generally to oilfield equipment and more particularly to systems and methods for a compliant compression plate for a slip hanger or a packoff.

2. Description of the Prior Art

A slip hanger, such as a manual slip hanger, is a type of wellhead equipment used with oilfield equipment to support the weight of oilfield tubulars strings in a wellbore; these oilfield tubulars may be a casing or tubing strings. The slip hanger may be installed within the wellhead and may include a series of slips that grip a casing string. A housing may be provided to hold the slip hanger in place. Further, a mechanism may be provided within the slip hanger for releasing and setting the slips. The slip hanger may be used in conjunction with a casing or tubing head, which may form part of a wellhead via a flanged, threaded, or other type of mechanical connection. The casing or tubing head may be referred to as a casing head herein, and the tubular may be referred to as a casing string. The casing head includes a bore that may be slightly larger than the casing string, which allows the casing string to be run through it. The slip hanger may be placed within casing head and the slips may be set to grip the casing string. For removal of the casing string, slips may be released by releasing the casing tension and the casing string can be pulled out of the wellbore. In a similar manner, a packoff is a mechanical seal used in oilfield equipment to prevent fluid leakage between sections of the equipment, such as to isolate the annulus volume from a bore volume in a wellhead. There may be many different components associated with the slip hanger or the packoff to enable their functioning.

SUMMARY

In at least one embodiment, a system for a slip hanger or a packoff to be used with oilfield equipment includes a compression plate having one or more grooves or slots extending circumferentially with respect to an axis of the slip hanger or the packoff. The compression plate is to be associated with an annulus seal gland of the slip hanger or the packoff and is to enable a gland volume of the annulus seal gland to change with temperature applied to the slip hanger or the packoff.

In at least one embodiment, a compression plate to be used with a slip hanger or a packoff in oilfield equipment is disclosed. The compression plate has one or more grooves or slots extending circumferentially with respect to an axis of the slip hanger or the packoff. The compression plate is to be associated with an annulus seal gland of the slip hanger or the packoff and is to enable a gland volume of the annulus seal gland to change with temperature applied to the slip hanger or the packoff.

In at least one embodiment, a method for using a slip hanger or a packoff in an oilfield equipment includes determining a load or temperature to be applied to the slip hanger or the packoff. The method includes enabling a compression plate to be associated with an annulus seal gland of the slip hanger or the packoff. The compression plate includes one or more grooves or slots extending circumferentially with respect to an axis of the slip hanger or the packoff. The one or more grooves or slots is to enable a gland volume of the annulus seal gland to change with temperature applied to the slip hanger or the packoff.

BRIEF DESCRIPTION OF DRAWINGS

Some of the features and benefits of the present disclosure having been stated, others will become apparent as the description proceeds when taken in conjunction with the accompanying drawings, in which.

Figure 1:
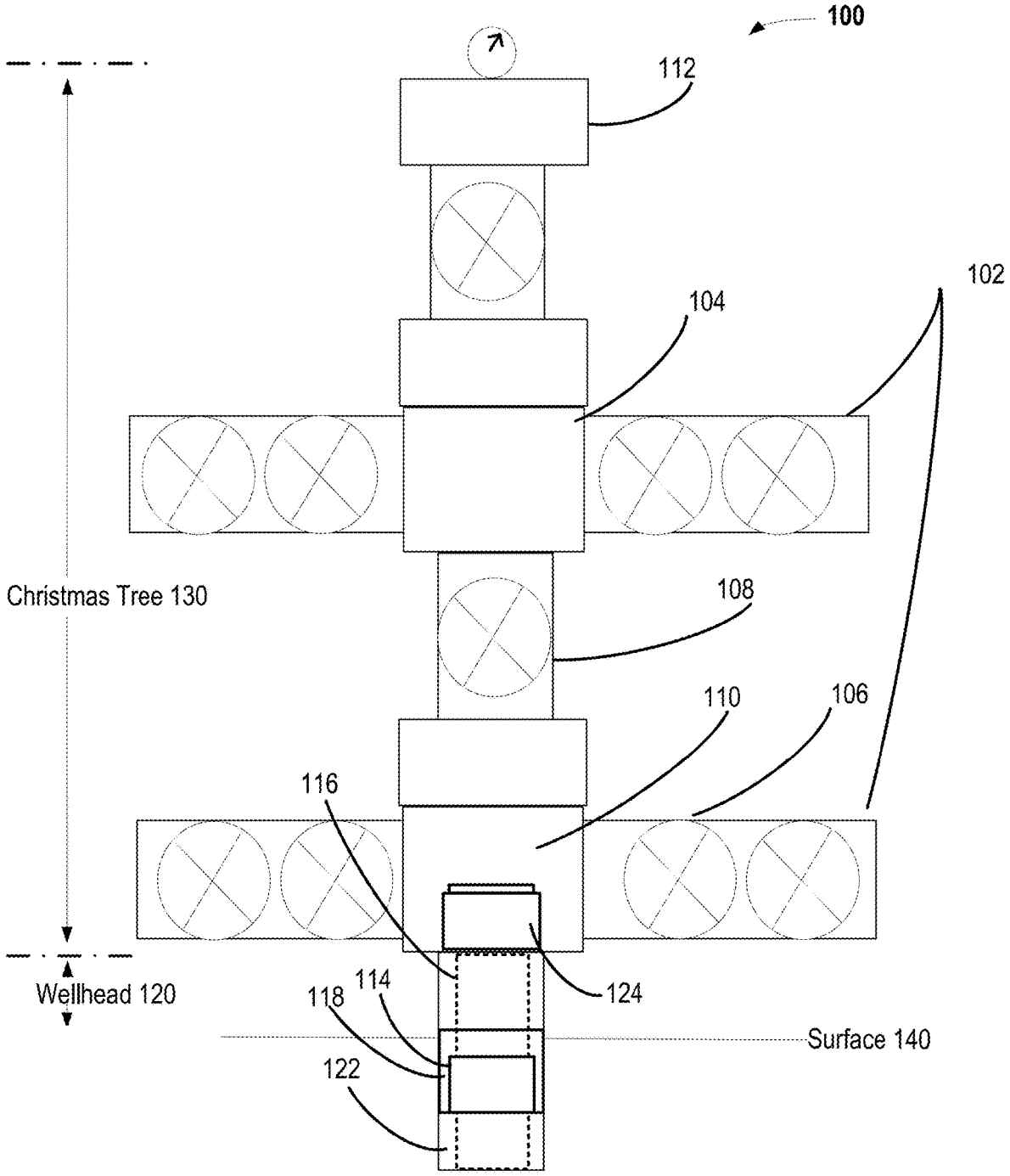
FIG. 1 is a block diagram of certain oilfield equipment that is subject to a compression plate within at least a slip hanger or a packoff, as detailed herein and in accordance with at least one embodiment.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

In at least one embodiment, to resolve issues described above, a compliant compression plate can be used with a slip hanger or a packoff in oilfield equipment. The compression plate is complaint because, in part, it includes one or more grooves or slots that extend circumferentially with respect to an axis of the slip hanger or the packoff. The compression plate can enable a preload to an annulus seal gland associated with the slip hanger or the packoff and can enable a gland volume of the annulus seal gland to change with temperature applied to the slip hanger or the packoff.

In at least one embodiment, a slip hanger or packoff may be used with a compression seal and may include an integral compliant section. The compliant section may include the compression plate and may be replaceable to provide a different spring stiffness to a seal system or a packoff, which also accommodates thermal effects depending on the application. The compliant section may be a series of machined features, such as the above referenced grooves or slots to the compression plate. Further, within a compression plate, the grooves or slots may be non-uniform, such as a different widths, heights, depths, and other geometric variations to provide different configurations. In at least one embodiment, there may be compression plates that have uniform grooves or slots.

In at least one embodiment, the machined features are grooved or slots that provide a predetermined stiffness to the seal system including a packoff or to a slip hanger. The compliant section can deform at a predetermined spring rate under loads, such as thermal loads, from an expanding and contracting seal. The deforming of the compliant section allows a preload to an annulus seal gland associated with the slip hanger or the packoff and can enable a gland volume of the annulus seal gland to change with temperature applied to the slip hanger or the packoff. In at least one embodiment, the annulus seal gland is formed, in part, with inclusion of a slip bowl or a packoff body.

In at least one embodiment, therefore, a purpose of the compliant section is to accommodate for thermal expansion of a compression seal, which may include an elastomer seal, at high temperature. A further purpose of the compliant section is to provide compression force to a contracted seal at low temperature. The compliance of the compression plate is enabled across an engineered deflection range through the machined feature and functionally addresses the issues of a rigid gland, bowl, or body of a slip hanger or packoff.

In at least one embodiment, the machined features provide a compliant geometrical configuration that is integral to the compression plate. This geometrical configuration may be an arrangement of milled slots extending circumferentially with respect to an axis of the slip hanger or the packoff. Alternatively, the geometrical configuration may be a set of grooves that are continuous around a circumference of the compression plate, which make them radial grooves.

In at least one embodiment, the grooves include one or more of first grooves that extend from an inner surface and partly towards an outer surface of the compression plate or second grooves that extend from an outer surface and partly towards an inner surface of the compression plate. When a compression plate includes one of a first groove and one of a second groove, the compression plate will have a serpentine cross-section. In at least one embodiment, when the geometrical configuration is slots extending from an inner surface, the slots are fully through an outer surface of the compression plate, unlike the first grooves, for instance.

The compression plate having the one or more of the grooves or slots can address issues in elastomer seals that undergo thermal expansion and/or contraction in a rigid gland, bowl, or body of a slip hanger or packoff. Instead of such rigidity, a complaint section of the grooves or slots, in the compression plate, flexes under load and accepts a preload as well as change in an annulus seal volume of an annulus seal gland of a slip hanger or packoff. As the compression seal contracts, the compliant section provides a compressive force on a compression seal, to accommodate for a reduction in a seal volume of the compression seal. As the compression seal expands, the compliant section flexes to accommodate for the increase in volume. These properties in the compliant section minimize the chances of extrusion at high temperature and minimize the loss of sealing contact pressure of the seal at low temperature. In at least one embodiment, further to the benefits described, there are fewer parts in using the compression plate herein, such as an absence of individual spring plates, spring washers, and other such features.

FIG. 1 is a block diagram of oilfield equipment 100 that is subject to the system of a slip hanger or packoff having a compression plate that includes one or more grooves or slots extending circumferentially with respect to an axis of the slip hanger or the packoff, as detailed herein and in accordance with at least one embodiment. The oilfield equipment 100 may include a Christmas tree 130 over a wellhead 120 located at or about a surface layer 140. The Christmas tree 130 may include on one or more branches 102 having valves thereon of the oilfield equipment 100.

Further, as illustrated in FIG. 1, oilfield equipment 100 may include a top connector 112 that is connected at a top of a studded cross 104. There may be multiple flow line gate valves and multiple kill line gate valves, generally illustrated as valves 106. These valves 106 may be on opposite sides of a studded cross 104. Further, the oilfield equipment may include one or more master gate valves 108, such as an upper and a lower master gate valve. A tubing head adapter may be connected between a tubing head 110 and at least one of the master gate valves 108.

In at least one embodiment, a system 114 of a slip hanger having a compression plate with grooves or slots may be used to perform operations associated with a tubing string 116 and may be located within a casing hanger spool 118. In at least one embodiment, further, a system 124 of a slip hanger having a compression plate with grooves or slots may be used to perform operations associated with a tubing string 116 and may be located within a tubing head 110 of the oilfield equipment 100.

In at least one embodiment, a system of a slip hanger having a compression plate with grooves or slots may be used with other hangers, including a tubing hanger associated with a tubing, a production casing hanger associated with a production casing, or an intermediate casing hanger associated with an intermediate casing. Therefore, the illustrated tubing string 116 may be a series of concentric oilfield tubulars (casing or tubing), each having an independent hanger that may benefit from the present system of a slip hanger having a compression plate with grooves or slots.

In at least one embodiment, a casing string may line walls of a wellbore and may be supported by a slip hanger 114 mounted to a wellhead 120, but associations to one or more of a casing hanger spool 118 or another feature. The slip hanger may be referred to also as a casing hanger. In at least one embodiment, wedge-shaped segmented slips may be provided for coupling between the slip hanger 114 and the tubing string 116. Further, compression seal assemblies may be provided for preventing pressure communication and may be provided between the tubing string 116 and wellhead 120.

In at least one embodiment, a system of a slip hanger 114 or a system of a packoff 124 may include a compression plate having machined features that, along with the compression seal, allow change in shape and volume for an annulus seal gland that includes a slip bowl or a packoff body under load that causes thermal effects to apply to the slip hanger or the packoff. The system 114 may be coupled together with threaded fasteners, including screws, bolts, studs, and nuts. These threaded fasteners may be torqued to an amount that causes the compression plate with grooves or slots to axially compress to provide a compressive preload force to the compression seal, to isolate the annulus between the tubing string 116 and wellhead 120. In at least one embodiment, instead of the threaded fasteners, the compression plate and the compression seal adjacent to the compression plate may be associated together by an internal lockdown. The internal lockdown may include other types of screws, such as lock screws without the aligned stud holes. These lock screws may be associated with the wellhead 120, and provide a compressive force to the slip hanger compression plate.

Figure 2A:
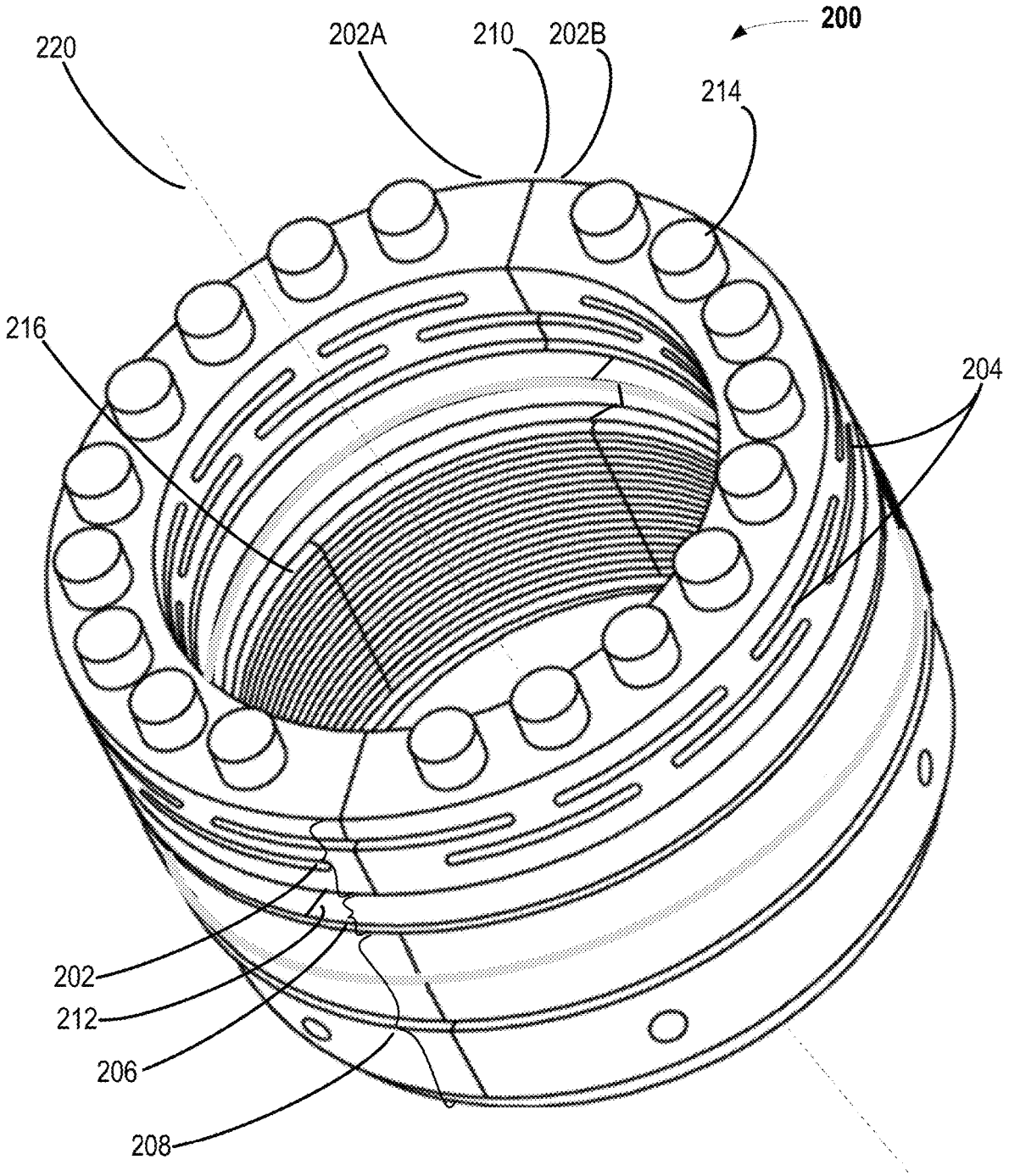
FIG. 2A is a perspective view of aspects of a system of a slip hanger having a slotted compression plate that can also be used with a packoff, in accordance with at least one embodiment.

FIG. 2A is a perspective view of aspects 200 of a system of a slip hanger having a slotted compression plate 202 that can also be used with a packoff, in accordance with at least one embodiment. In at least one embodiment, the system 114 is also referred to as seal assembly and the system 114; 124 is made up of a compression plate 202 having slots 204 (referred to also as a slotted compression plate), a compression seal or seal element 206, a slip bowl 208, and slips 216 that engage a casing string. Each of the compression plate 202, the compression seal 206, and the slip bowl 208 may be segments or semi-circular members, generally referred under the sections 202A, 202B. The sections 202A, 202B are joined at a split 210, and the seal assembly and the system 114; 124 is generally a segmented slip hanger or packoff. The compression seal 206 occupies an annulus seal gland, which is formed by a slip bowl 208 and portions of the tubular 116, the wellhead housing 120, the compression plate 202 that are annularly around the slip bowl 208. As a result, a gland volume of the annulus seal gland is in reference to the space formed within the slip bowl 208 and portions of the tubular 116, the wellhead housing 120, the compression plate 202 that are annularly around the slip bowl 208.

In at least one embodiment, the compression plate 202 is for a slip hanger or a packoff and forms at least one part of a slip bowl 208. In at least one embodiment, the compression plate 202 restrains the compression seal 206 in at least one direction. The compression plate 202 being of a predetermined stiffness, may be optimized based in part on an application of the slip hanger or a packoff. Such optimization may be based in part on factors associated with the application, including an operating temperature, a thermal expansion coefficient, a fastener preload, among other factors that are readily apparent to a skilled artisan reviewing the present disclosure.

The compliant section of the slotted compression plate 202 includes the slots 204 on the compliant plate that can flex axially relative to a wellbore 122 and can effectively compress under a fastener preload (such as from the fasteners 214) or under thermal expansion of the seal assembly and the system 114; 124. In at least one embodiment, the compliant section includes the slots 204 that may be axially separated from a top section and a bottom section that are solid materials (not slotted). This is further illustrated in a section view in FIGS. 4A and 4B. In an example, as illustrated in FIG. 2A (and FIGS. 4A, 4B), there may be multiple rows (axially separated) of slots 204 and the slots may be uniform or non-uniform. In at least one embodiment, each of the slots 204 may have a defined start and end point along a circumference of the compression plate 202 but may also extend fully from an inner diameter (inner surface) to an outer diameter (outer surface) of the compression plate 202.

In at least one embodiment, the axial separation between the rows may be less than an axial separation from a row of slots 204 till a top or a bottom of the compression plate 202. In this manner, a section having the slots 204 is apparent relative to another section not having slots on the compression plate 202. The section having the slots 204 may be the compliant section of the compression plate 202. The slots 204 may be of different geometry, when non-uniform slots 204 are used. The compression seal 206 may be in a compressed state. As the elastomer of the compression seal 206 contracts under cold temperatures and in application, a volume of an annulus seal gland changes (a volume formed by the slip bowl 208 and portions of a tubular 116, a wellhead housing 120, and the compression plate 202 that are around the slip bowl 208, as readily appreciated by a skilled artisan). Such a change may cause a volume of the annulus seal gland to shrink to maintain the same pressure as initially intended.

In at least one embodiment, a change in the gland volume enables one or more of features associated with the annulus seal gland. The change enables a preload, in the annulus seal gland, to be maintained at a first temperature in which a compression seal that is associated with the slip hanger or the packoff contracts. The change enables an expansion of the compression seal without extrusion at a second predetermined temperature in which the compression seal expands. Further, the first temperature is a low temperature relative to the second temperature which may be many times higher than the first temperature.

In at least one embodiment, the compression seal 206 may be also bisectional having semi-circular members, along the sections 202A, 202B, joined together along a split 212 that may be offset from the split 210 for the compression plate 202. Further, in at least one embodiment, the compression plate 202 has two segments of machined features and may be joined at the split 210 but may have multiple segments instead. Example materials for at least the compression plate 202 include elastic materials, such as carbon steel or stainless steel, whereas the compression seal 206 may be of an elastomer material. In at least one embodiment, such elastomer may include hydrogenated nitrile butadiene rubber (HNBR) or Polyether ether ketone (PEEK). In at least one embodiment, the compression plate 202 can help to achieve a good seal at a low temperature. This is at least because a strain energy stored in the compression plate 202, at an ambient temperature, may be released at the low temperature to compensate for thermal contraction of the elastomer material.

In at least one embodiment, the sections are axially fastened together from a top side of the compression plate 202 using fasteners 214 that are threaded and that thread into a bolt hole, and through the compression seal 206 before reaching the slip bowl 208. Even though illustrated below the compression plate 202, the compression seal 206 may be above the compression plate 202, in at least one embodiment. The fasteners 214 may be hexagonal headed socket but may be any suitable lock screws or studs used to bring together the compression plate 202 and the compression seal 206.

Figure 2B:
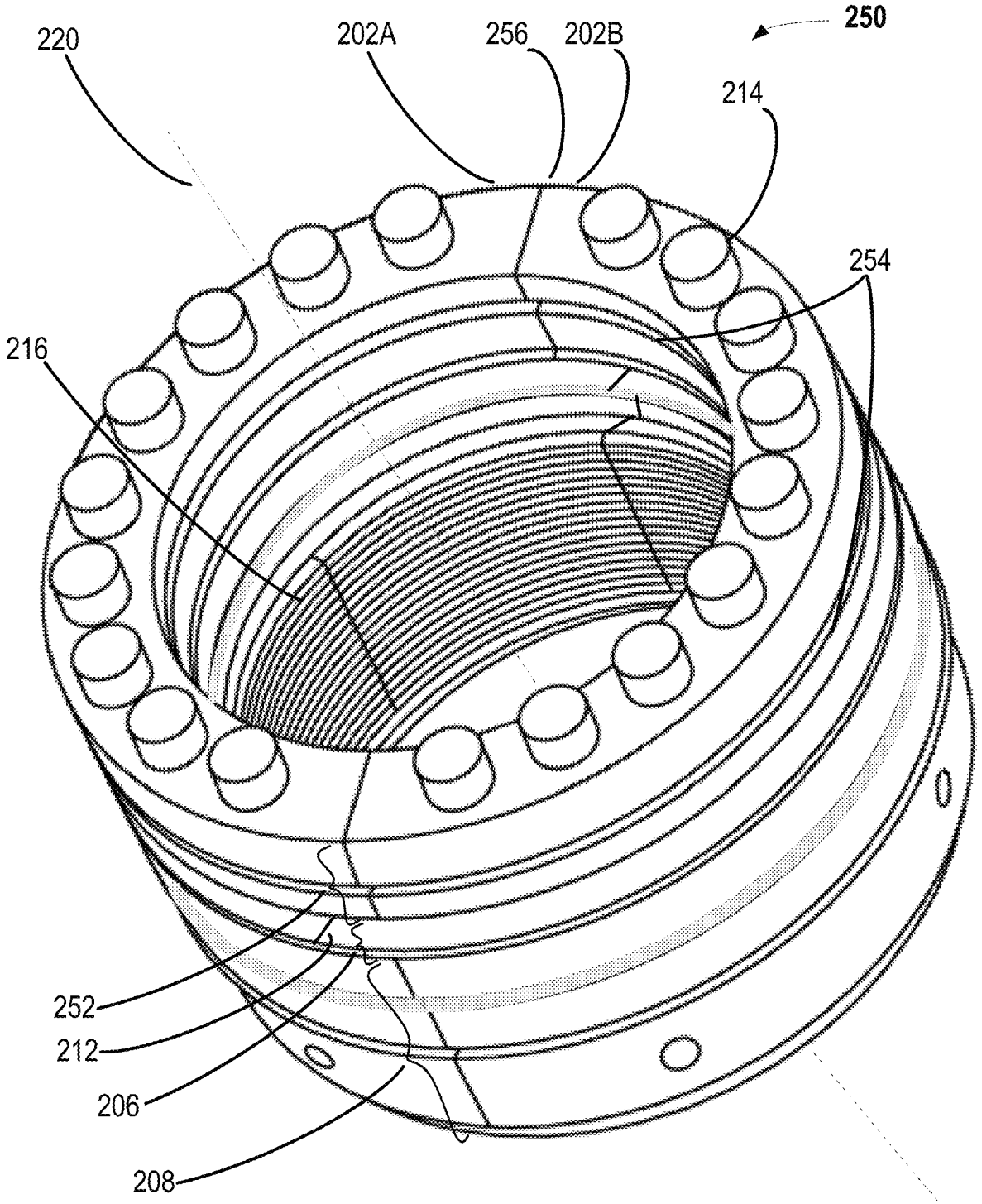
FIG. 2B is a perspective view of aspects of a system of a slip hanger having a grooved compression plate that can also be used with a packoff, in accordance with at least one embodiment

FIG. 2B is a perspective view of aspects 250 of a system of a slip hanger having a grooved compression plate 252 that can also be used with a packoff, in accordance with at least one embodiment. In at least one embodiment, like in FIG. 2A, the system 114 (or seal assembly) 114; 124 may be made up of a compression plate 252 having grooves 254 (referred to also as a grooved compression plate), a compression seal or seal element 206, a slip bowl 208, and slips 216 that engage a casing string. Each of the compression plate 252, the compression seal 206, and the slip bowl 208 may be segments or semi-circular members, generally referred under the sections 202A, 202B. The sections 202A, 202B are joined at a split 256, and the seal assembly and the system 114; 124 is generally a segmented slip hanger or packoff.

In at least one embodiment, the compression plate 252 is for a slip hanger or a packoff and forms at least one part of a slip bowl 208. In at least one embodiment, the compression plate 252 restrains the compression seal 206 in at least one direction. The compression plate 252 may be being of a predetermined stiffness, which may be optimized based in part on an application of the slip hanger or a packoff. Like in the case of the slotted compression plate 202, such optimization may be based in part on factors associated with the application, including an operating temperature, a thermal expansion coefficient, a fastener preload, among other factors that are readily apparent to a skilled artisan reviewing the present disclosure.

The compliant section includes the grooves 254 on the compliant plate 202 that can flex axially relative to a wellbore 122 and can effectively compress under a fastener preload (such as from the fasteners 214) or under thermal expansion of the seal assembly and the system 114; 124. In at least one embodiment, the compliant section includes the groove 254 that may be axially separated from a top section and a bottom section that are solid materials (not grooved). This is further illustrated in a section view in FIGS. 5A and 5B. In an example, as illustrated in FIG. 2B (and FIGS. 5A, 5B), there may be multiple grooves 254 (that are axially separated) and the grooves may be uniform or non-uniform.

In at least one embodiment, each of the grooves 254 may extend fully around a circumference of the compression plate 252, unlike the slots 204, and may also not extend fully from an inner diameter (inner surface) to an outer diameter (outer surface) of the compression plate 252. Instead, the grooves 252 include one or more grooves, including first grooves (such as, on top) that extend from an inner surface and partly towards an outer surface of the compression plate 252 and/or second grooves (such as at the bottom from the first groove) that extend from an outer surface and partly towards an inner surface of the compression plate.

In at least one embodiment, the axial separation between the grooves 254 may be less than an axial separation from a groove 254 till a top or a bottom of the compression plate 252. In this manner, a section having the grooves 254 is apparent relative to another section not having such grooves 254 on the compression plate 252. The section having a groove 254 may be the compliant section of the compression plate 252. The grooves 254 may be of different width and height geometry (but extend fully around a circumference), when uniform or non-uniform grooves are used. The compression seal 206 may be in a compressed state. As the elastomer of the compression seal 206 contracts under cold, the volume of the annulus seal gland changes.

In at least one embodiment, like in the embodiment in FIG. 2A, the compression seal 206 may be also bisectional having semi-circular members, along the sections 202A, 202B, joined together along a split 212 that may be offset from the split 256 for the compression plate 252. Further, in at least one embodiment, the compression plate 252 has two segments of machined features and may be joined at the split 256 but may have multiple segments instead. Example materials for at least the compression plate 252 include elastic materials, such as carbon steel or stainless steel. In at least one embodiment, the compression plate 252 can help to achieve a good seal at a low temperature. This is at least because a strain energy stored in the compression plate 252, at an ambient temperature, may be released at the low temperature to compensate for thermal contraction of the elastomer material.

In at least one embodiment, the sections are axially fastened together from a top side of the compression plate 252 using fasteners 214 that are threaded and that thread into a bolt hole, and through the compression seal 206 before reaching the slip bowl 208. Even though illustrated below the compression plate 252, like in the embodiment in FIG. 2A, the compression seal 206 may be above the compression plate 202, in at least one embodiment. The fasteners 214 may be hexagonal headed socket but may be any suitable lock screws or studs used to bring together the compression plate 252 and the compression seal 206.

Figure 3A:
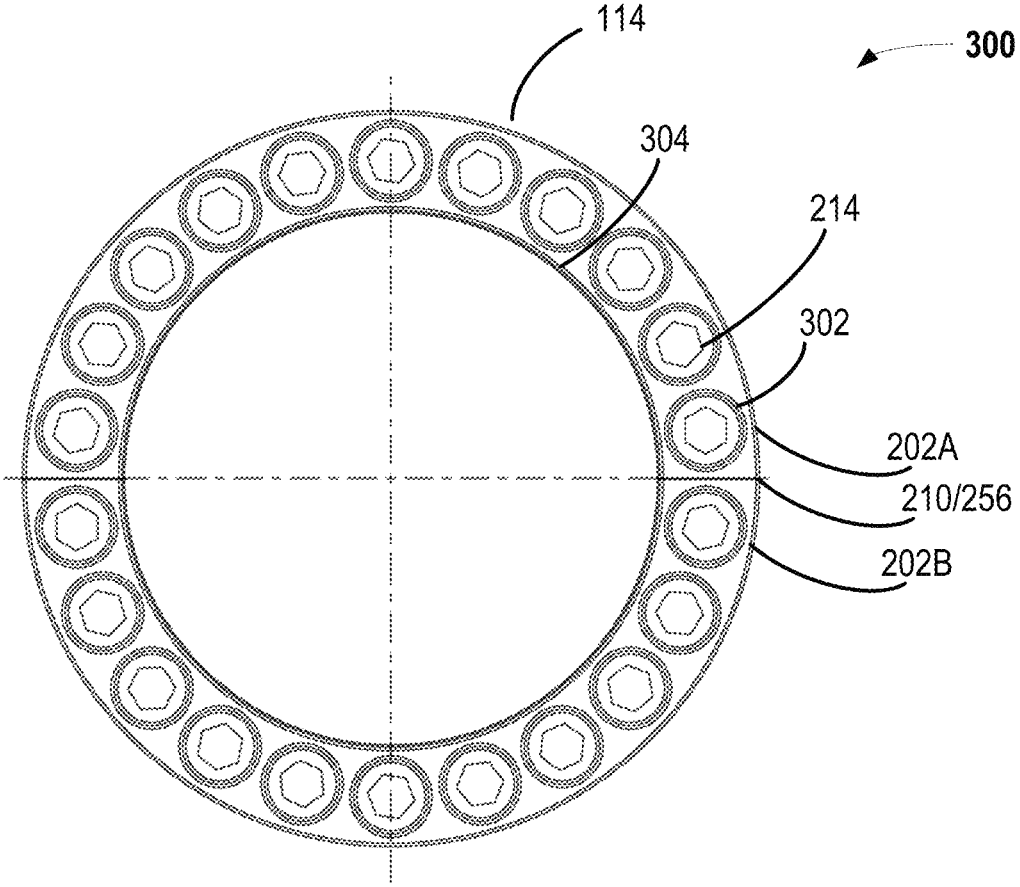
FIG. 3A is a top view of aspects of a system of a slip hanger or a packoff having a compression plate, in accordance with at least one embodiment.

FIG. 3A is a top view of aspects 300 of a system 114 of a slip hanger or a system 124 of a packoff having a grooved or slotted compression plate 202; 252 in accordance with at least one embodiment. The sections 202A, B illustrated in FIG. 3A are axially fastened together using fasteners 214 that are threaded and that thread into a bolt hole 302 in the slip bowl 208. The fasteners 210 are illustrated as hexagonal headed socket bolts, studs, or screws, for example purposes. FIG. 3A also illustrates that the system 114 includes an area 304 to allow mounting of the system over a tubing string 116. In at least one embodiment, the system 114 for a slip hanger is mounted on a tubing string 116 lowered into a wellhead 120 to support the weight of tubing string 116 in the wellbore 122.

Figure 3B:
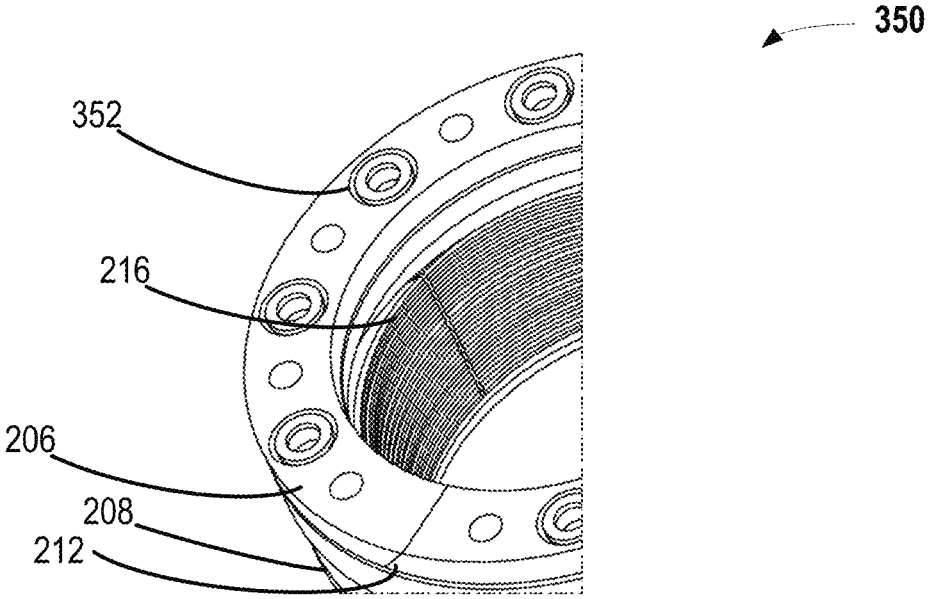
FIG. 3B is a perspective view of aspects of a system of a slip hanger or a packoff having an arrangement of a compression seal with bolt holes, in accordance with at least one embodiment.

FIG. 3B is a perspective view of aspects 350 of a system of a slip hanger or a packoff having an arrangement of a compression seal 206 with bolt holes 352, in accordance with at least one embodiment. FIG. 3B also illustrates that the compression seal 206 may include embedded anti-extrusion rings and may include the bolt holes 352 that align with bolt holes 302 of a compression plate that is overlying or underlying relative to the compression seal 206. The bolt holes 352 aligned in this manner can pass through a fasteners 214 from an overlying compression plate or can pass through a screw to an underlying compression plate. There may be additional anti-extrusion rings or gaskets provided within the bolt holes 352.

Figures 4A, 4B:
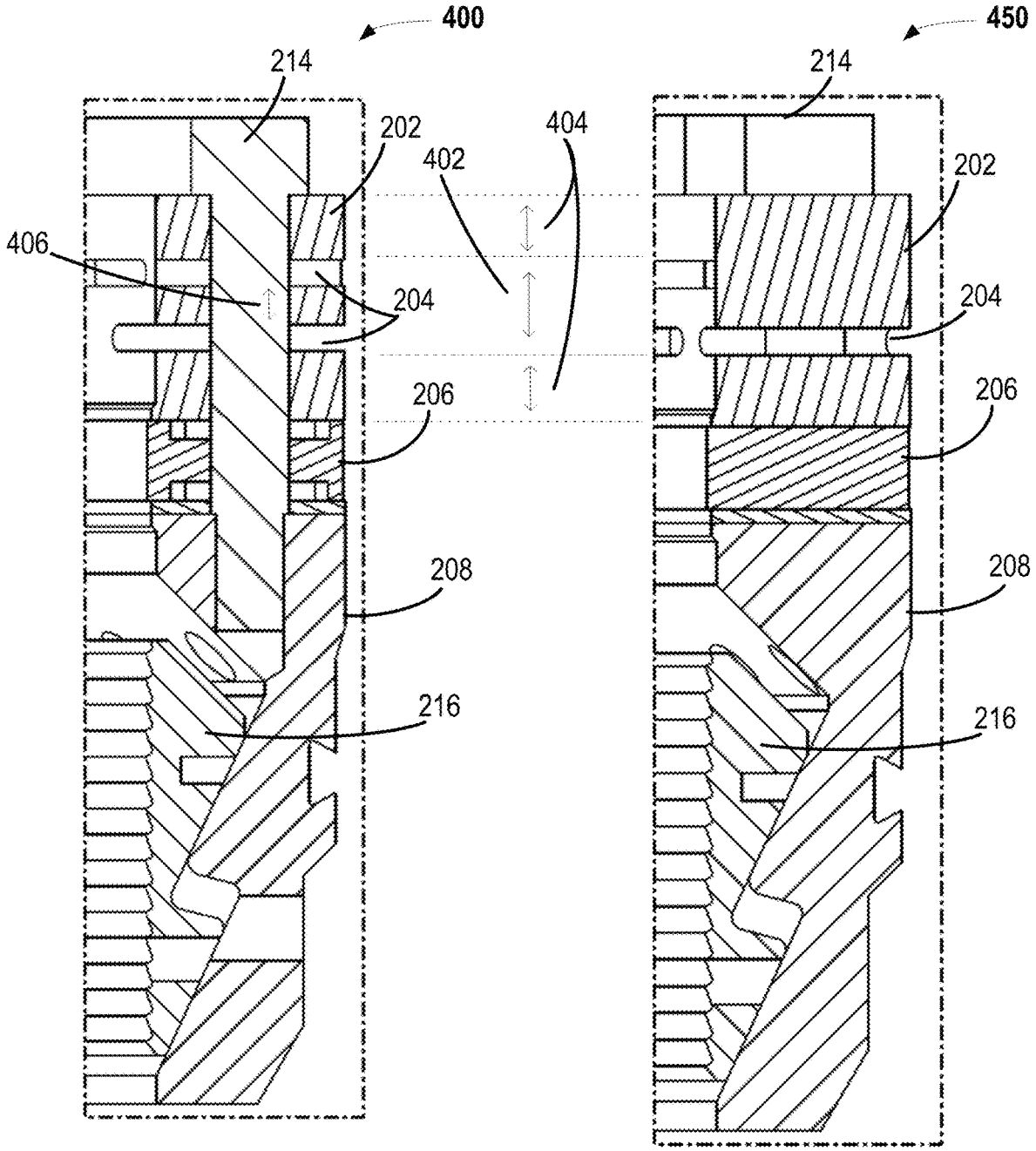
FIG. 4A is a detailed section view of aspects of a system of a slip hanger having a slotted compression plate, such as from FIG. 2A, that can also be used with a packoff, in accordance with at least one embodiment.
FIG. 4B is a further detailed section view of aspects of a system of a slip hanger having a slotted compression plate, such as from FIG. 2A, that can also be used with a packoff, in accordance with at least one embodiment.

FIGS. 4A and 4B are detailed section views of aspects 400, 450 of a system of a slip hanger having a slotted compression plate 202, such as from FIG. 2A, that can also be used with a packoff, in accordance with at least one embodiment. FIG. 4A illustrates a detailed section view at a screw 214 passing through the compression plate 202, a compression seal 206, and a slip bowl or packoff body 208.

FIG. 4A illustrates a detailed section view at a non-screw area of the slotted compression plate 202.

In at least one embodiment, FIGS. 4A, 4B illustrate the compliant section 402 that includes the slots 204 that may be axially separated from a top section and a bottom section 404 that are solid materials (not slotted). FIG. 4A, 4B also illustrate that there may be multiple rows (axially separated 406) of slots 204 and the slots may be uniform or non-uniform. In at least one embodiment, each of the slots 204 may have a defined start and end point along a circumference of the compression plate 202 but may also extend fully from an inner diameter (inner surface) to an outer diameter (outer surface) of the compression plate 202. In at least one embodiment, the axial separation 406 between the rows may be less than an axial separation from a row of slots 204 to a top or to a bottom of the compression plate 202, as made apparent by the markers for the non-compliant sections 404. In this manner, a section 402 having the slots 204 is apparent relative to another section 404 not having slots on the compression plate 202. The section 402 having the slots 204 may be the compliant section of the compression plate 202.

Figure 5A:
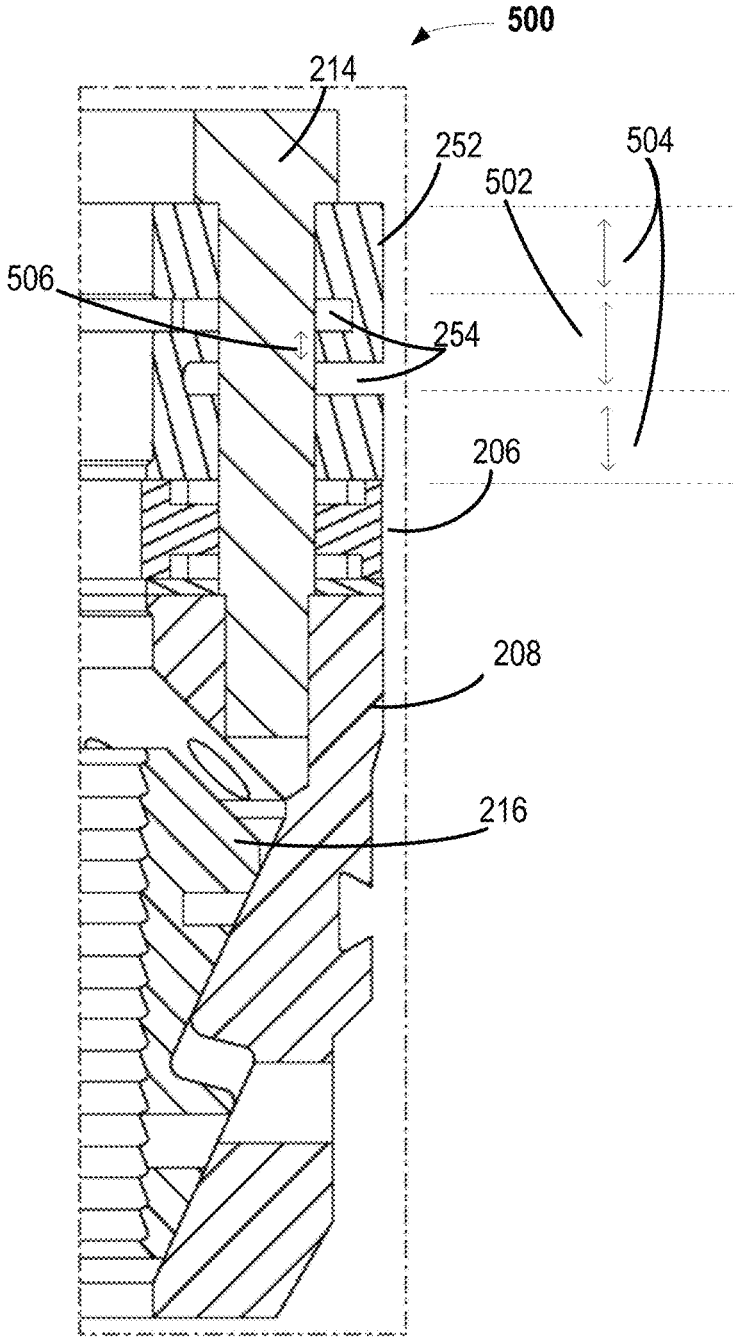
FIG. 5A is a detailed section view of aspects of a system of a slip hanger having a grooved compression plate, such as from FIG. 2B, that can also be used with a packoff, in accordance with at least one embodiment.
Figure 5B:
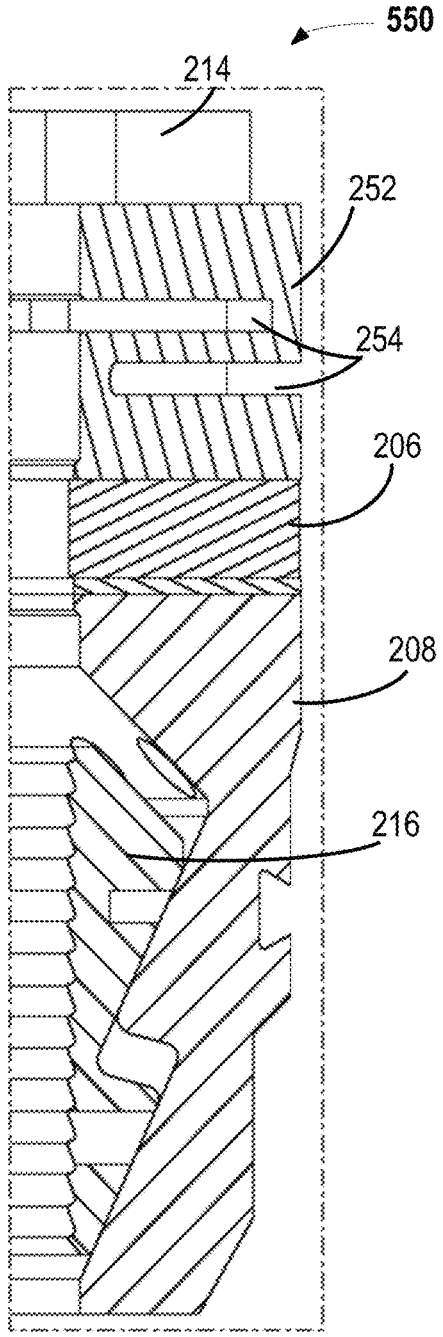
FIG. 5B is a further detailed section view of aspects of a system of a slip hanger having a grooved compression plate, such as from FIG. 2B, that can also be used with a packoff, in accordance with at least one embodiment.

In at least one embodiment, FIGS. 5A, 5B illustrate the compliant section 502 that includes the grooves 254 that may be axially separated from a top section and a bottom section 504 that are solid materials (not grooved). FIG. 5A, 5B also illustrate that there may be multiple grooves 254 that are axially separated 506 and that the grooves may be uniform or non-uniform. In at least one embodiment, each of the grooves 254 may extend around a circumference of the compression plate 252 and only extend partly from an inner diameter (inner surface) to an outer diameter (outer surface) or from an outer diameter to an inner diameter of the compression plate 252. In at least one embodiment, the axial separation 506 between the rows may be less than an axial separation from a groove 254 to a top or to a bottom of the compression plate 202, as made apparent by the markers for the non-compliant sections 504. In this manner, a section 502 having the grooves 254 is apparent relative to another section 504 not having grooves 254 on the compression plate 252. The section 502 having the grooves 254 may be the compliant section of the compression plate 252.

In at least one embodiment, a system 114 of a slip hanger or a system 124 of a packoff to be used with oilfield equipment therefore includes a compression plate 202; 252 having one or more of grooves 254 or slots 204 extending circumferentially with respect to an axis 220 of the slip hanger or the packoff 114; 124. The compression plate 202, 252 can enable a preload to an annulus seal gland of an annulus seal associated with the slip hanger or the packoff 114; 124 and can enable a gland volume of the annulus seal gland to change with temperature applied to the slip hanger or the packoff 114; 124 under a load applied there to. For example, the load may be from the fasteners 214 being tightened prior to application in a wellhead or may be from supporting the weight of casing string in the wellhead, or from thermal contraction or expansion of a compression seal under thermal load.

In at least one embodiment, a compression seal 206 may be located adjacent to the compression plate 202; 252. The compression seal 206 may include an elastomer material. The system 114 of a slip hanger or the system 124 of a packoff may include a slip bowl, or packoff body that may be subject to change in volume. Further, the compression plate 202; 252 extends circumferentially in the slip hanger to accommodate multiple fasteners 214 and to associate the compression plate 202; 252 with the compression seal.

The system for a slip hanger (or separately, a packoff) may include the one or more of such compression plates 202; 252 having the one or more slots or groove 204, 254 can be interchangeable, where an application of one of the compression plates 202, 252 can be based in part a loading subject to in the slip hanger or the packoff. This allows for customization, such as to enable different heights, spans, numbers, or relative placement configuration of the compression plate 202; 252, to be adjustable to enable compliance and deflection that are customized in accordance with an application of the slip hanger.

The system for a slip hanger (or separately, a packoff) may be such that the compression plate 202; 252 enables resistance and stress differences. Further, the compression plate 202; 252 can enable compliance for the system 114; 124 under the load or a temperature applied to the slip hanger or packoff. In at least one embodiment, the system 114 for a slip hanger is such that the slots or grooves of the compression plate 202; 252 includes more than one row of slots or grooves.

The system for a slip hanger (or separately, a packoff) may be such that grooves 254 are continuous around a circumference of the compression plate 252. Further, the grooves 254 may include one or more of first grooves that extend from an inner surface and partly towards an outer surface of the compression plate 252 or second grooves that extend from an outer surface and partly towards an inner surface of the compression plate 252.

The system for a slip hanger (or separately, a packoff) may be such that individual ones of the slots 204 extend from an inner surface and fully through an outer surface of the compression plate 202. The system for a slip hanger (or separately, a packoff) may be such that the compression plate 202; 252 is interchangeable based in part on an application of the slip hanger 114 or the packoff 124.

The system for a slip hanger (or separately, a packoff) may be such that there may be replaceable compression plates that each include different geometric configurations of grooves or different configurations of slots. Further, individual ones of the compression plates can address different compliance and can be used to replace a compression plate depending on an application. For example, in an application of the slip hanger or the packoff, the compression plate is selectable to the application, with the individual ones of the compression plates being directed to different applications in a slip hanger or a packoff. In at least one embodiment, the slip hanger or packoff may be retrieved and the compression plate may be replaced with a same, similar, or different compression plate having grooves or slots according to a requirement presently in a wellbore.

Figure 6A:
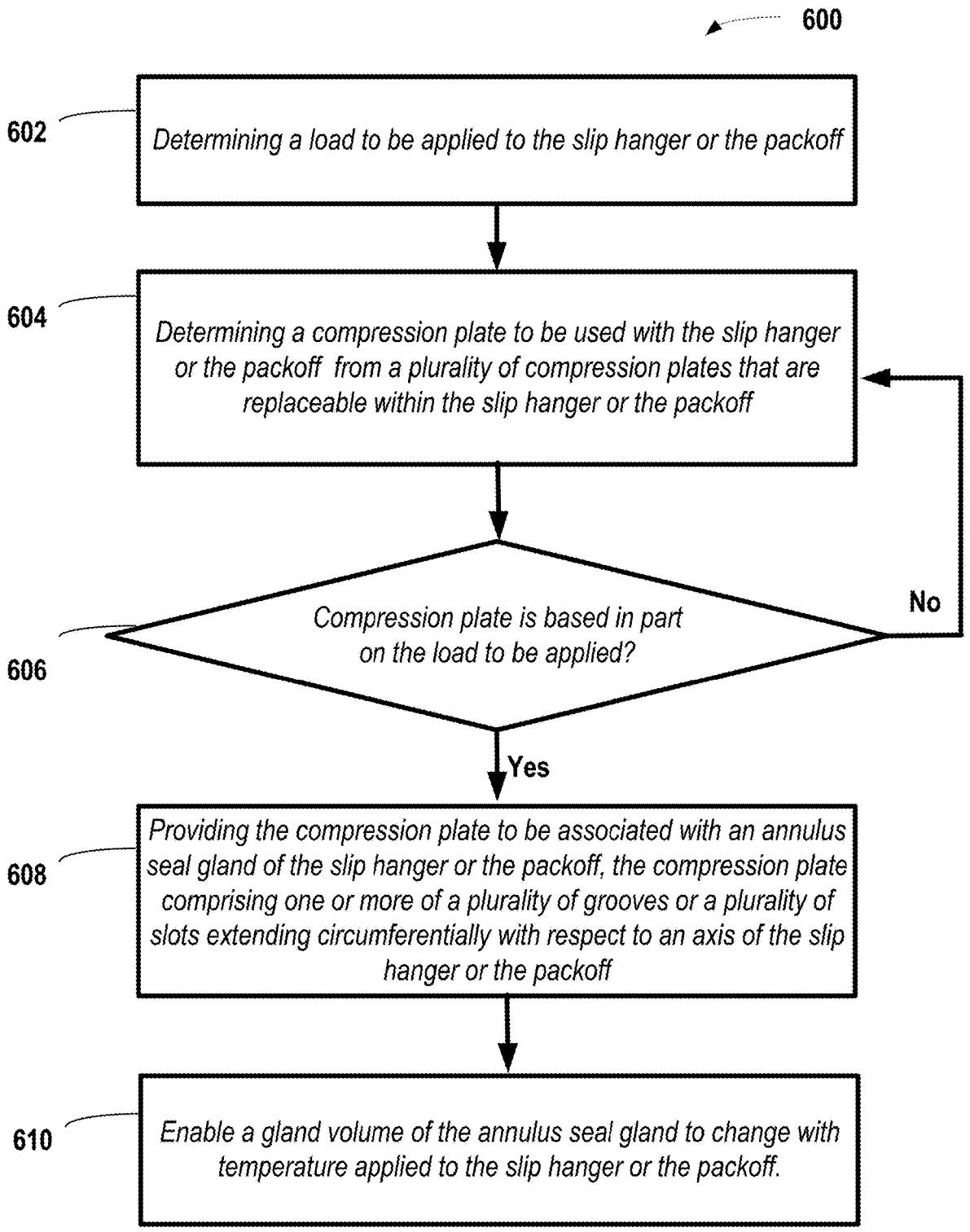
FIG. 6A is a flow diagram of a method for a system of a slip hanger or a packoff having a compression plate that is described at least in FIGS. 1-5B herein, in accordance with at least one embodiment.

FIG. 6A is a flow diagram of a method 600 for a slip hanger or a packoff to be used with an oilfield equipment that is described at least in FIGS. 1-5B herein, in accordance with at least one embodiment. The method 600 includes determining (602) a load or a temperature to be applied to the slip hanger or the packoff in operation of the slip hanger or the packoff. The method 600 further includes determining (604) a compression plate to be used with the slip hanger or the packoff from a number of compression plates that are replaceable within the slip hanger or the packoff. This may be based in part on the load or temperature to be applied from step 602. In at least one embodiment, a determining or verifying (606) may be performed that one of the number of compressions plates is based in part on the load or the temperature from step 602.

In at least one embodiment, the method 600 includes providing (608) the compression plate to be associated with an annulus seal gland of the slip hanger or the packoff. The compression plate includes one or more of grooves or slots extending circumferentially with respect to an axis of the slip hanger or the packoff. The one or more of the grooves or slots enables (610) a gland volume of the annulus seal gland to change with temperature applied to the slip hanger or the packoff. Further, in step 610, the annulus seal gland is enabled to receive preload associated with the slip hanger or the packoff.

Figure 6B:
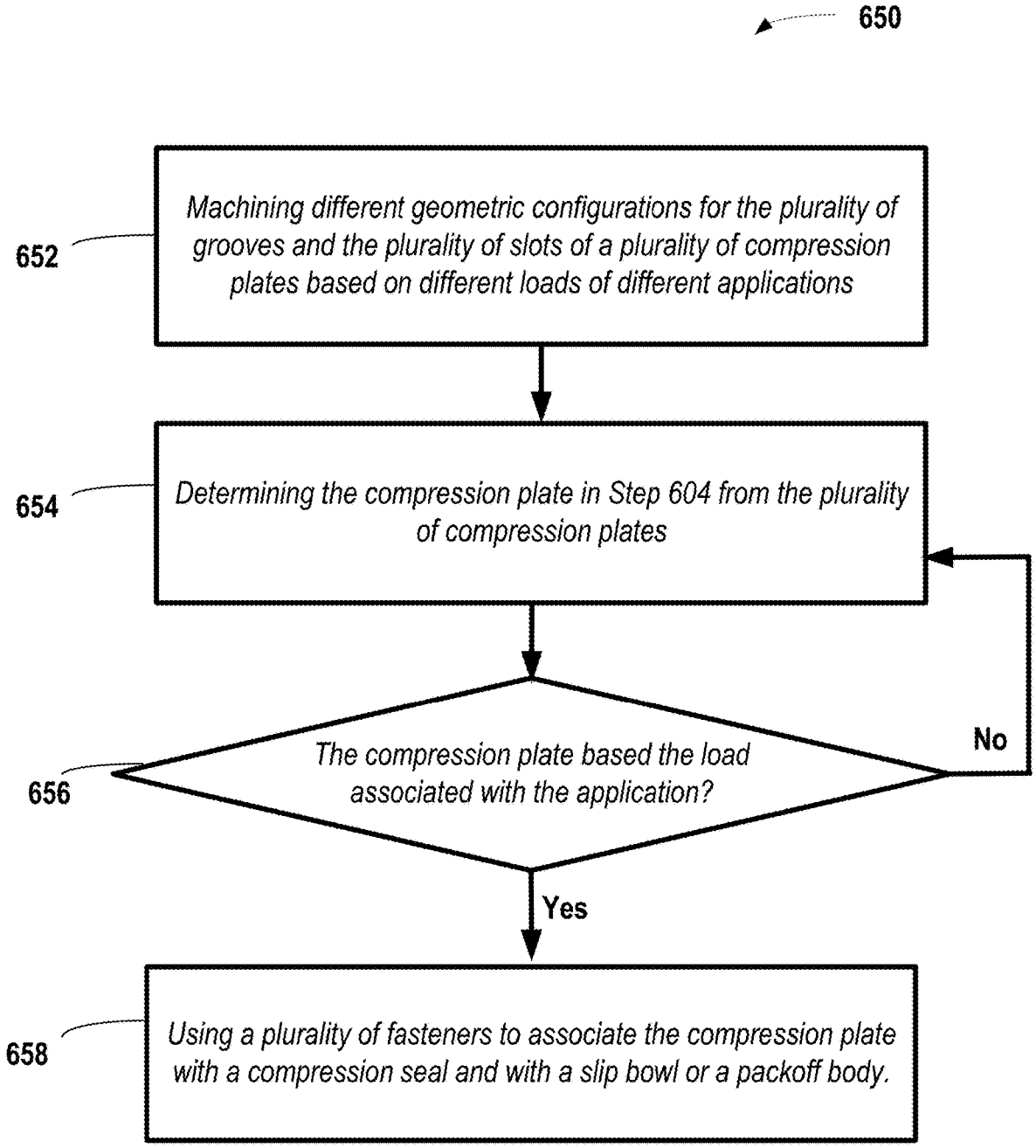
FIG. 6B is a flow diagram of a further method for a system of a slip hanger or a packoff having a compression plate that is described at least in FIGS. 1-5B herein, in accordance with at least one embodiment.

FIG. 6B is a flow diagram of a further method 650 for a system of a slip hanger or a packoff having a compression plate that is described at least in FIGS. 1-5B herein, in accordance with at least one embodiment. In at least one embodiment, the method 650 is associated with preparing a slip hanger or a packoff. The method 650 includes machining (652) different geometric configurations for the grooves and the slots of different compression plates based on different loads or temperatures of different applications. The method 650 includes selecting (654) the compression plate for the determining step 604 from the different compression plates.

The method 650 includes determining or verifying (656) that the compression plate in step 654 is based on a load or a temperature of an application in which the slip hanger or packoff is to be used. The method 650 includes using fasteners to associate the compression plate with a compression seal and with a slip bowl or a packoff body. In at least one embodiment, method 600; 650 can include a further step or sub-step for providing a compression seal located adjacent to the compression plate and to be comprised of an elastomer material. In at least one embodiment, method 600; 650 can include a further step or sub-step for enabling the grooves of a compression plate to be continuous around a circumference of the compression plate. This may be part of the machining step 652 in method 650, for instance.

In at least one embodiment, method 600; 650 can include a further step or sub-step for enabling the plurality of grooves to include one or more of first grooves that extend from an inner surface and partly towards an outer surface of the compression plate or second grooves that extend from an outer surface and partly towards an inner surface of the compression plate. This may be also part of the machining step 652 in method 650, for instance. In at least one embodiment, method 600; 650 can include a further step or sub-step for enabling the individual ones of the slots to extend from an inner surface and fully through an outer surface of the compression plate.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages and can be used in a variety of applications. Various embodiments may be combined or modified based in part on the present disclosure, which is readily understood to support such combination and modifications to achieve the benefits described above.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art and are intended to be encompassed within the spirit of the present disclosure disclosed herein and the scope of the appended claims.

What is claimed is:

1. A system for a slip hanger to be used with oilfield equipment, comprising:

a plurality of slip segments; and a compression plate comprising bolt holes to associate with the plurality of slip segments and comprising one or more of a plurality of grooves or a plurality of slots extending circumferentially with respect to an axis of the slip hanger that is around a tubular, the compression plate to be associated with an annulus seal gland of the slip hanger and to enable a gland volume of the annulus seal gland to change with temperature applied to the slip hanger, wherein the gland volume comprises a space formed within a slip bowl of the slip hanger and at least portions of the tubular, a wellhead housing, and the compression plate.

2. The system of claim 1, wherein the change in the gland volume enables one or more of:

a preload in the annulus seal gland to be maintained at a first temperature in which a compression seal that is associated with the slip hanger contracts; or an expansion of the compression seal without extrusion at a second predetermined temperature in which the compression seal expands, wherein the second temperature is higher than the first temperature.

3. The system of claim 1, wherein the plurality of grooves are continuous around a circumference of the compression plate.

4. The system of claim 1, wherein the plurality of grooves comprise one or more of first grooves that extend from an inner surface and partly towards an outer surface of the compression plate or second grooves that extend from an outer surface and partly towards an inner surface of the compression plate.

5. The system of claim 1, wherein individual ones of the plurality of slots extend from an inner surface and fully through an outer surface of the compression plate.

6. The system of claim 1, wherein the compression plate is interchangeable based in part on an application of the slip hanger.

7. The system of claim 1, further comprising:

a plurality of compression plates comprising different geometric configurations of a plurality of second grooves or a plurality of second slots, individual ones of the plurality of compression plates to address different compliance than the compression plate, in an application of the slip hanger, wherein the compression plate is replaceable in the application with at least one of the of the individual ones of the plurality of compression plates.

8. A compression plate to be used with a slip hanger that comprises a plurality of slip segments and that is around a tubular in oilfield equipment, the compression plate comprising bolt holes to associate with the plurality of slip segments and comprising one or more of a plurality of grooves or a plurality of slots extending circumferentially with respect to an axis of the slip hanger, the compression plate to be associated with an annulus seal gland of the slip hanger and to enable a gland volume of the annulus seal gland to change with temperature applied to the slip hanger, wherein the gland volume comprises a space formed within a slip bowl of the slip hanger and at least portions of the tubular, a wellhead housing, and the compression plate.

9. The compression plate of claim 8, wherein the plurality of grooves are continuous around a circumference of the compression plate.

10. The compression plate of claim 8, wherein the plurality of grooves comprise one or more of first grooves that extend from an inner surface and partly towards an outer surface of the compression plate or second grooves that extend from an outer surface and partly towards an inner surface of the compression plate.

11. The compression plate of claim 8, wherein individual ones of the plurality of slots extend from an inner surface and fully through an outer surface of the compression plate.

12. The compression plate of claim 8, wherein the compression plate is interchangeable with one of a plurality of compression plates, based in part on an application of the slip hanger, the plurality of compression plates comprising different geometric configurations of a plurality of second grooves or a plurality of second slots, individual ones of the plurality of compression plates to address different compliance than the compression plate, in the application of the slip hanger.

13. A method for a slip hanger to be used around a tubular of an oilfield equipment, comprising:

determining a load or a temperature to be applied to the slip hanger that comprises a plurality of slip segments;

determining a compression plate to be used with the slip hanger from a plurality of compression plates that are replaceable within the slip hanger, based in part on the load or the temperature to be applied; and providing the compression plate to be associated with an annulus seal gland of the slip hanger, the compression plate comprising bolt holes to associate with the plurality of slip segments and comprising one or more of a plurality of grooves or a plurality of slots extending circumferentially with respect to an axis of the slip hanger, the one or more of the plurality of grooves or the plurality of slots to enable a gland volume of the annulus seal gland to change with temperature applied to the slip hanger, wherein the gland volume comprises a space formed within a slip bowl of the slip hanger and at least portions of the tubular, a wellhead housing, and the compression plate.

14. The method of claim 13, further comprising:

providing a compression seal located adjacent to the compression plate and to be comprised of an elastomer material.

15. The method of claim 13, further comprising:

enabling the plurality of grooves to be continuous around a circumference of the compression plate.

16. The method of claim 13, further comprising:

enabling the plurality of grooves to comprise one or more of first grooves that extend from an inner surface and partly towards an outer surface of the compression plate or second grooves that extend from an outer surface and partly towards an inner surface of the compression plate.

17. The method of claim 13, further comprising:

enabling the individual ones of the plurality of slots to extend from an inner surface and fully through an outer surface of the compression plate.

18. The method of claim 13, wherein the plurality of compression plates comprises different geometric configurations of a plurality of second grooves or a plurality of second slots, individual ones of the plurality of compression plates to address different compliance than the compression plate, in different applications comprising different loads or temperatures on the slip hanger.

19. The method of claim 13, further comprising:

machining different geometric configurations for the plurality of grooves and the plurality of slots of the compression plate and for a plurality of second grooves and a plurality of second slots of a plurality of compression plates, based in part on different loads or temperatures enabled for the slip hanger, wherein different applications are associated with the different loads or temperatures on the slip hanger.

20. The method of claim 13, further comprising:

fastening the compression plate with a compression seal located adjacent to the compression plate using a plurality of fasteners associated with a plurality of fastener holes through the compression plate, through the compression seal, and into the slip bowl.

* * * * *